United States Patent [19]

Hanyu

[11] Patent Number: 5,035,193

[45] Date of Patent: Jul. 30, 1991

[54] CONTINUOUS HEM STITCHING SEWING MACHINE

[75] Inventor: Susumu Hanyu, Tokyo, Japan

[73] Assignee: Janome Sewing Machine Co. Ltd., Tokyo, Japan

[21] Appl. No.: 249,851

[22] Filed: Sep. 27, 1988

[30] Foreign Application Priority Data

Oct. 7, 1987 [JP] Japan ..... 62-251667

[51] Int. Cl.[5] ..... D05B 3/02

[52] U.S. Cl. ..... 112/266.1; 112/454; 112/457; 112/458

[58] Field of Search ..... 112/454, 458, 456, 453, 112/457, 121.11, 121.12, 266.1

[56] References Cited

U.S. PATENT DOCUMENTS 4,522,137 6/1985 Takenoya et al. ..... 112/266.1

4,664,047 5/1987 Sano ..... 112/458 X

*Primary Examiner*—Peter Nerbun

*Attorney, Agent, or Firm*—Michael J. Striker

[57] ABSTRACT

A sewing machine for and a method of stitching a mark of a predetermined shape onto a fabric, in which the mark is stitched onto the fabric by selective employment of stitch patterns stored in a memory device of the sewing machine and wherein selected patterns form a single pattern of stitches corresponding to the predetermined shape of the mark.

2 Claims, 8 Drawing Sheets

CONTINUOUS HEM STITCHING SEWING MACHINE

FIELD OF THE INVENTION

The present invention relates to a zigzag sewing machine, and more particularly to a sewing machine which includes a memory unit for storing patterns to be combined for stitching to a uniform, and by which hems of the patterns may be continuously stitched with determined constant width.

BACKGROUND OF THE INVENTION

Sport players' numbers are formed on uniforms by stitching hems of the numbers as patterns with predetermined V width by using an embroidery sewing machine used exclusively therefor, and an ordinary sewing machine. When using these sewing machines, considerable skillfulness is required.

SUMMARY OF THE INVENTION

It is an object of the invention to provide a sewing machine which may easily form hem stitches by ordinary operation.

The object of the invention is achieved by a sewing machine which is provided with a static memory device storing a plurality of stitching pattern data, a controlling device including a read-out device which makes available pattern data of stitching patterns selected per each of synchronous pulses of an upper shaft to be generated from the static memory device by a needle position detector, and driving means controlling actuations of a needle bar and a fabric feed device. A continuous hem stitching sewing machine of the invention comprises a memory device storing stitching patterns to be combined with predetermined parts and continuous parts, selecting means of the combined stitching pattern, an amplitude signal detecting means for discriminating whether a forming pattern is at the predetermined part or the continuous part, and lift lever detecting means that allows to form the predetermined part according to selection of the combined pattern being stitched to the continuous part.

DETAILED DESCRIPTION OF PREFERRED EMBODIMENTS

Embodiments of the invention will be explained with reference to examples of forming the sport players' numbers on the uniforms.

Figure 2:
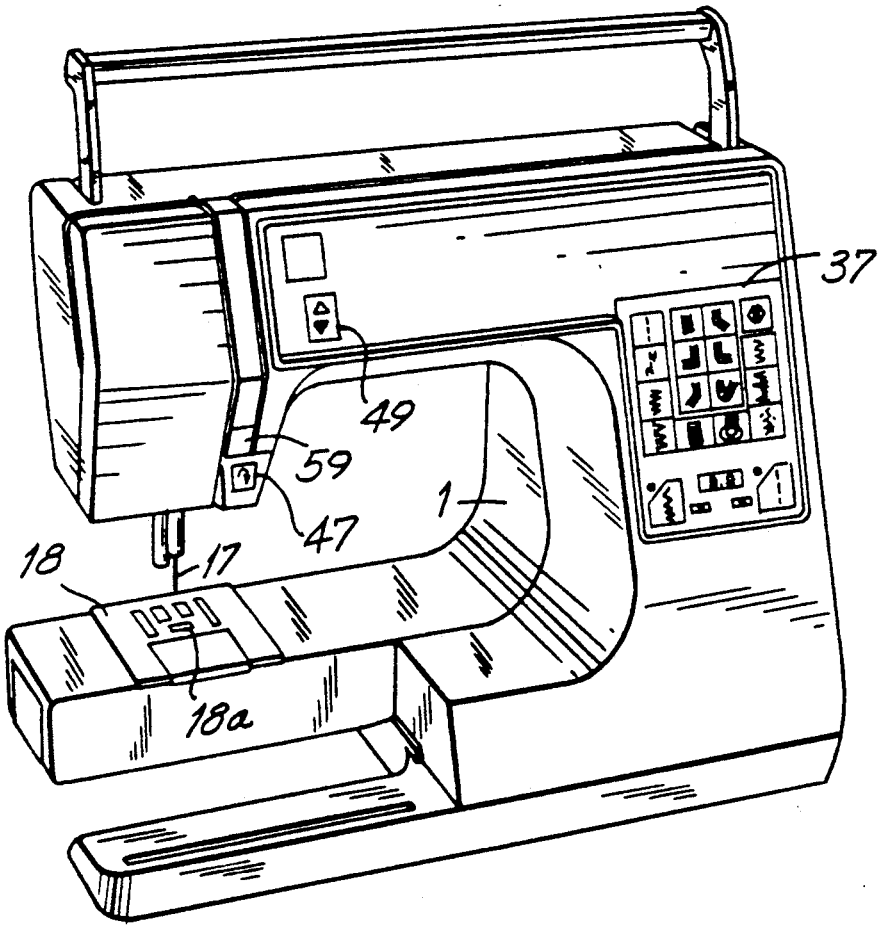
FIG. 2 is a perspective view of the sewing machine provided with an improved device of the invention.

FIG. 2 shows a perspective view of a sewing machine of the invention. The sewing machine comprises a machine frame 1 that holds a needle 17 so that it may reciprocate vertically and laterally so as to form locked stitches together with a thread loop catching means 28 disposed under a needle dropping hole 18*a* of a needle plate 16.

Figure 3:
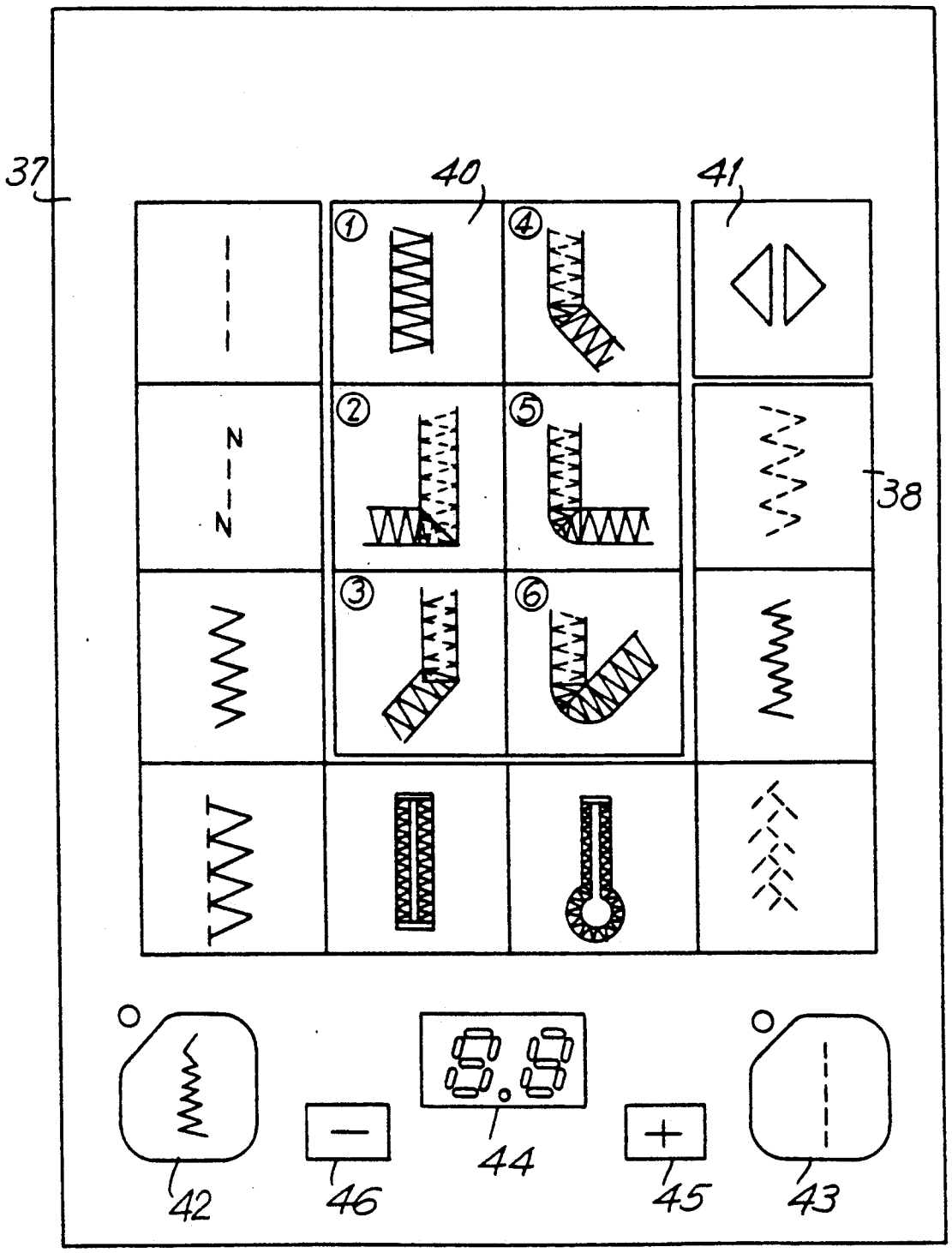
FIG. 3 is an explanatory view of functions of the sewing machine of the invention.
Figure 4:
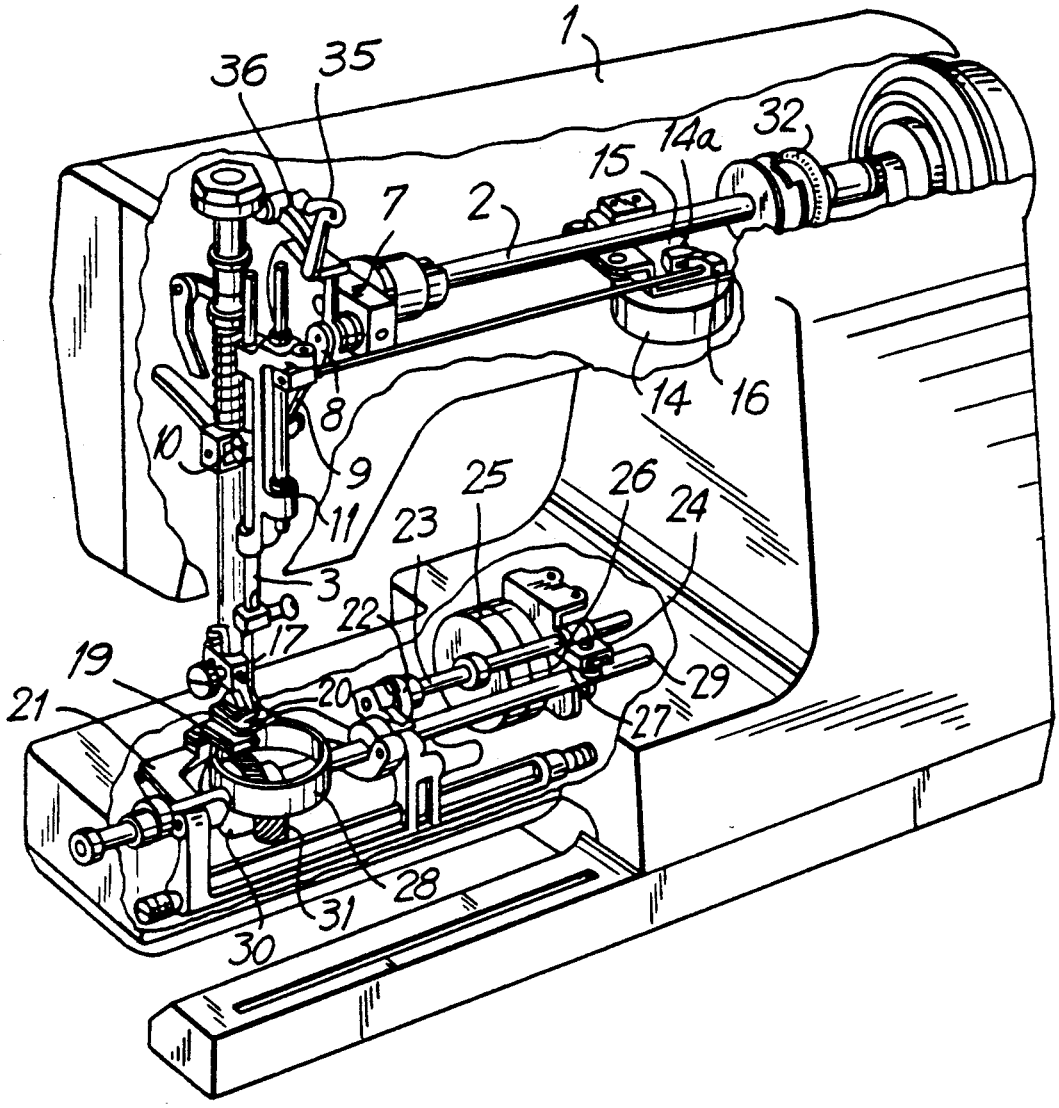
FIG. 4 is an explanatory view of an interior structure of the sewing machine.

A selection device 37 is, as shown in FIG. 3, provided with a pattern selecting means 39 (FIG. 1) actuated by a pattern selection button 38 on a panel. Selection of patterns 1 to 6 is effected by a selection switch of ordinary stitching patterns.

An inversion key 41 inverts the selected pattern.

Further, an amplitude selecting device 42, a feed selecting device 43, an indicating device 44, an increasing device 45 and a decreasing key 46 are provided on the panel. The vibration selecting device 42 selects amplitudes of the needle 17 for an automatic condition and for a manual condition. The feed selecting device 43 selects feeding amount for the automatic condition and for the manual condition. The indicating device 44 indicates determined values of the manual condition. The increasing key 45 and the decreasing key 46 control the determined values of the manual condition.

A key 47 provided on the housing 1, operates to produce reverse stitches specifically required for the straight stitches to prevent the stitches from loosening (or fraying) at the beginning and the end of the stitches. If the key 47 is operated when any pattern other than the straight stitches is stitched, finishing lock stitches are produced for the same purpose as in the case of the straight stitches.

A stopping position selecting key 49 is operated to select a stop of an upper dead point and a stop of a lower dead point of the needle 17.

A pattern re-designation switch 59 is for indicating continuing use of a combined pattern which has been selected in a preceding time for combined stitchings, and it is positioned adjacent to the reverse stitching key 47 to facilitate the stitching operation.

A needle bar 3 is mounted on a machine frame 1 and is vertically movable in connection with the upper shaft 2 which is rotatably mounted (journalled) on the machine frame. Namely, as generally known, the needle bar 3 is slidably inserted into a needle bar support 11 and is fixedly connected to a needle holder 10 which is connected to a needle bar crank 8 by a crank rod 9. The crank 8 is operatively connected to as a balance weight 7 secured to one end of the upper shaft 2 for rotation therewith. The needle bar support 11 is pivotally mounted on a vertical shaft 12 secured to the machine frame 1, and is secured against vertical movement. The needle bar support 11 is connected to one end of a rod 13 which has the other end connected to an arm 15 secured on an output shaft 14*a* of a stepping motor 14 for controlling the needle position.

A feed dog 19 is mounted on a horizontal feed arm 21 to be driven by the drive shaft 2. The movement of the horizontal feed arm 21 is adjusted by adjusting the angular position of a member 22 fixed to one end of an adjusting shaft 23, which has the other end secured to an arm 24 connected to a crank 26 mounted on the output shaft of a feed control stepping motor 25 by way of a crank 26 and a link 27.

A loop taker 28 serves as needle thread hooking means and is supported rotatably on a machine frame 1 under the needle plate 18. A gear 30 is secured to a lower shaft 29 which is rotated in synchronism with the needle bar 3 by the upper shaft 2, and meshes with a gear 31 fixed integrally with the loop taker 28.

Figure 9:
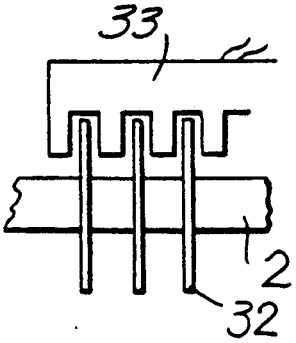
FIG. 9 is a view showing a means for detecting rotational phases of the upper shaft.
Figure 5A:
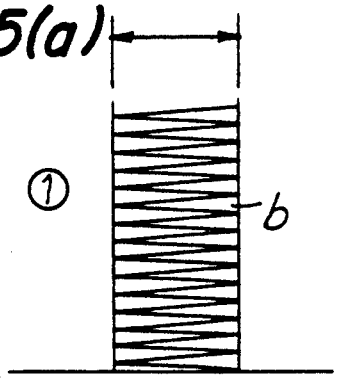
FIGS. 5(*a*)–5(*f*) are explanatory views of stitching hems of player's numbers as patterns.
Figure 5B:
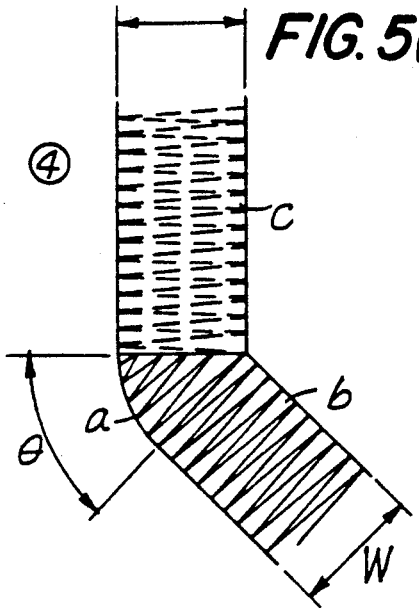
Figure 5C:
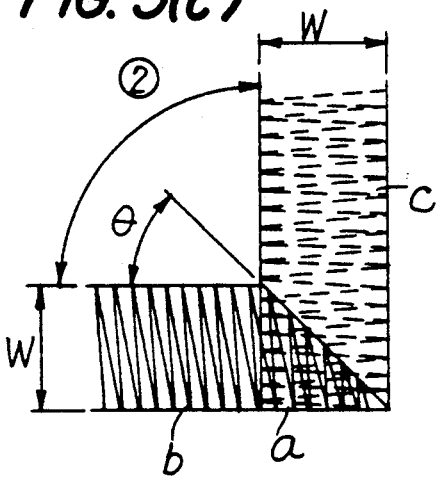
Figure 5D:
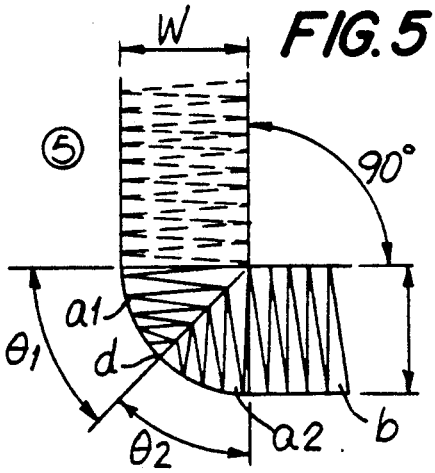
Figure 5E:
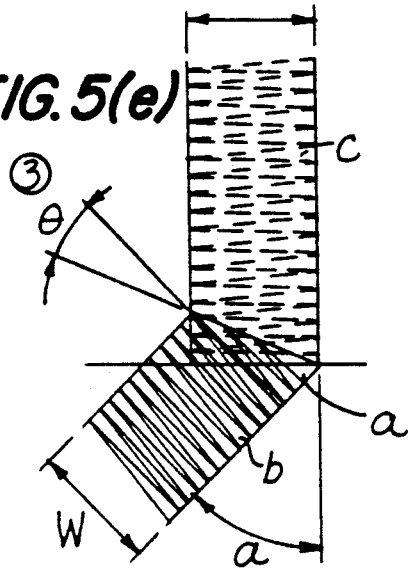
Figure 5F:
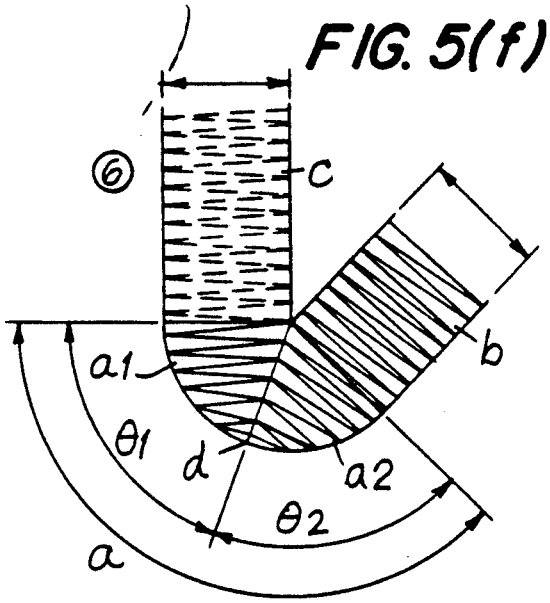

Rotary discs 32 are, as shown in FIG. 9, formed with slits, and mounted on the upper shaft 2. The rotary discs constitute means 34 for detecting rotational phases of the upper shaft device 60 detects rotation of the means 34. A take-up lever 35 is connected to the crank 7 via a link 36.

A reference will be made to a controlling device of the sewing machine.

A pattern memory 49 stores amplitude values and feed amounts of stitching patterns selected by the pattern selecting device 39 in accordance with a pattern to be stitched.

With respect to combined patterns as shown in FIG. 5 respectively, other patterns than a continuous pattern (1) are composed of a pattern (a) of a predetermined part for bending and connecting with stitches (c) shown with dotted lines, and a series of stitches (b) formed by zigzag stitches having constant amplitude continued from the predetermined part, and connected to a central processing unit 50. In the combined patterns, one of them has one predetermined part as shown in FIG. 5, (2) to (4), and the other has two predetermined parts (a1) and (a2) shown in FIG. 5, (5) to (6).

Figure 1:
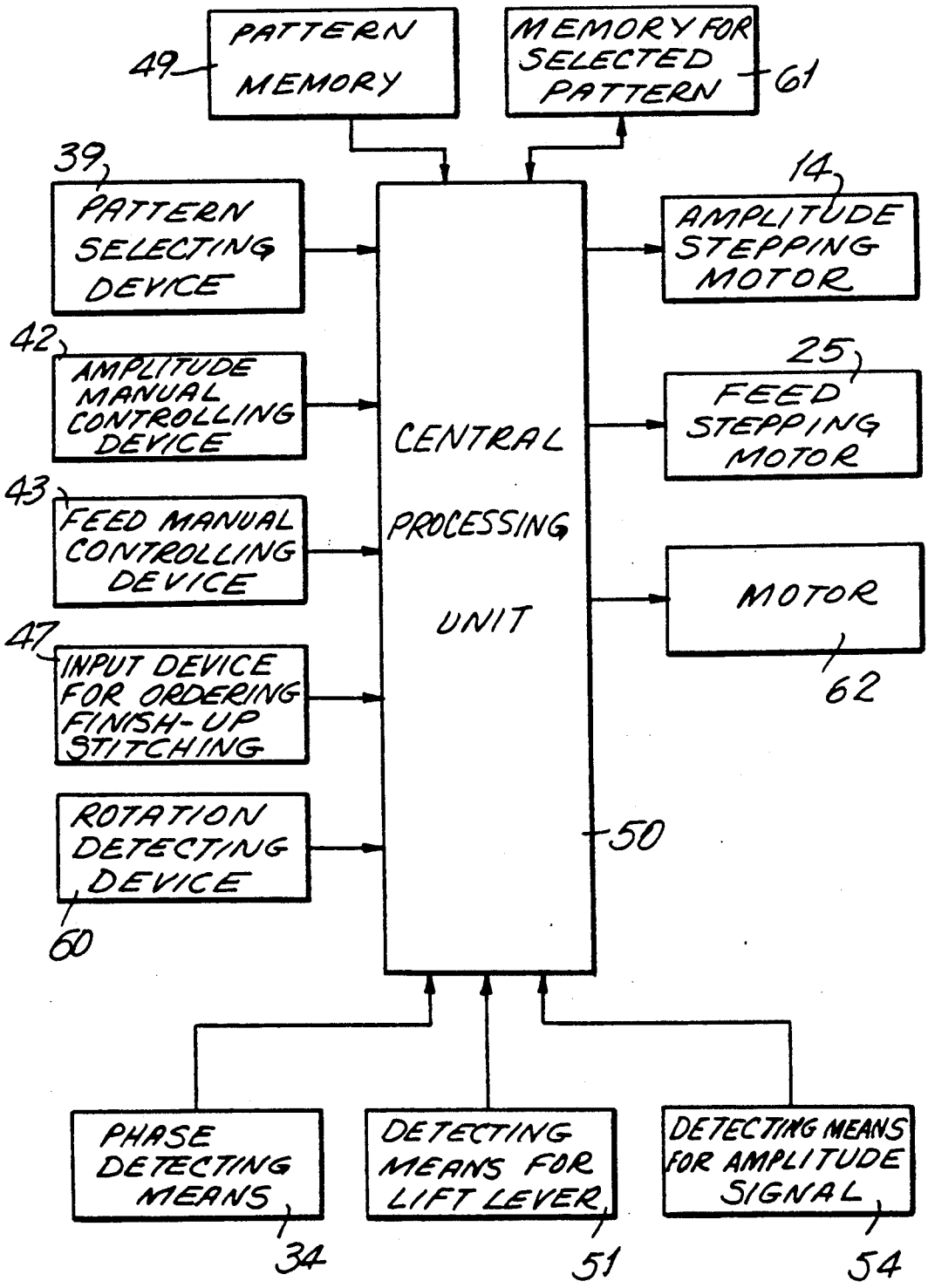
FIG. 1 is a flow chart showing selections of patterns in the sewing machine of the invention.
Figure 6:
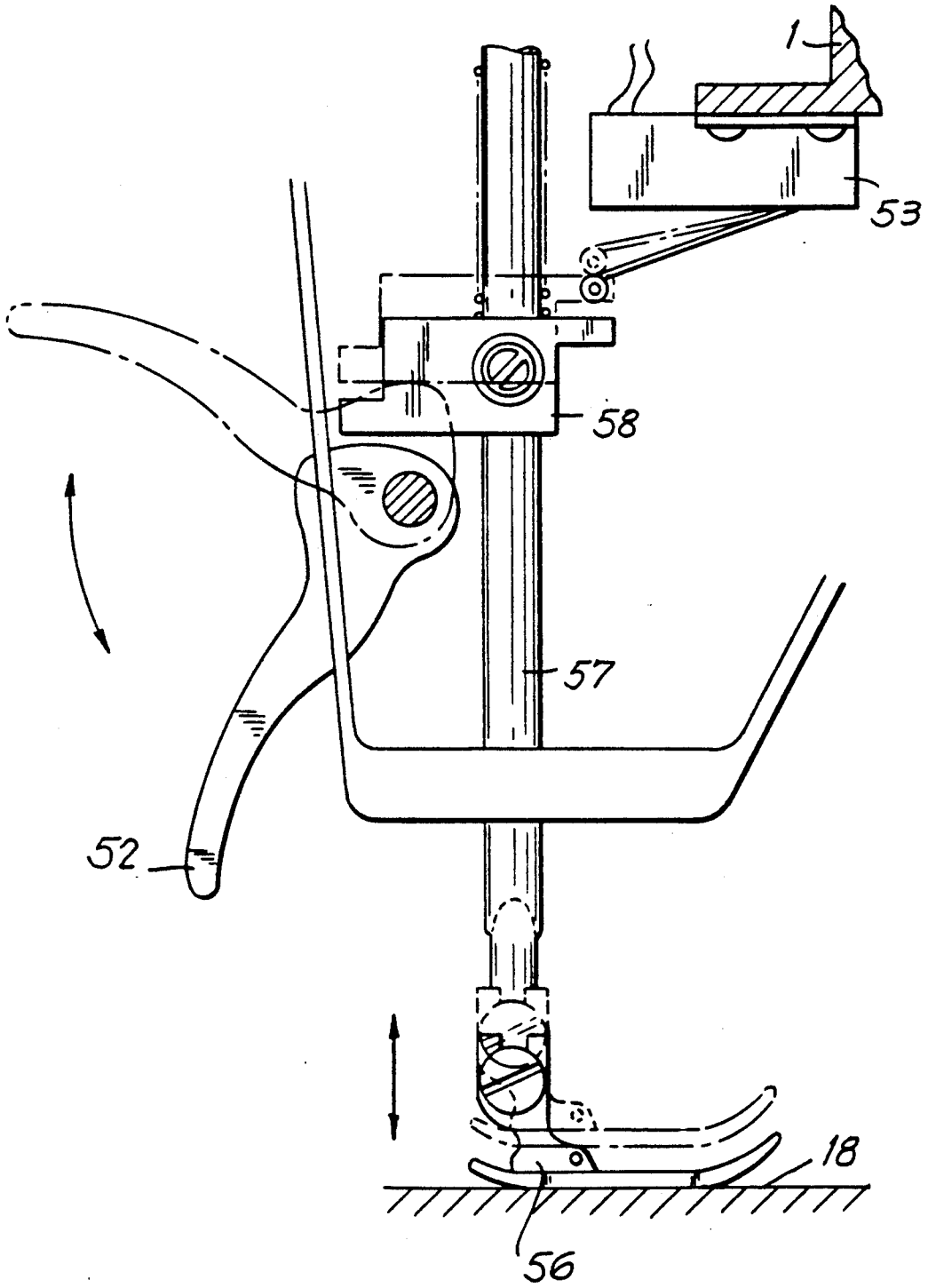
FIG. 6 is a view showing lift lever detecting means.

The numeral 51 of FIG. 1 shows a lift lever detecting means. As shown in FIG. 6, a presser bar holder 58 is secured on a presser bar 57 which holds a fabric presser foot 56 at its lower part, and a lift lever 52 is rotatably pivoted on the machine frame 1. When the lift lever 52 is turned upwardly, the presser bar holder 58 pushes the presser bar 57 upwardly, accordingly.

The machine frame 1 is provided with a microswitch 53 and a counter (not shown). When the presser bar holder 58 is lifted up by turning the lever 52, the holder 58 contacts at its upper surface to the microswitch 53. The counter is connected to the microswitch 53 electrically for counting actions of the latter, and is connected to the central processing unit 50 so that the counted value is reset at 0 by operation of the pattern selection device 39.

Detecting means 54 of amplitude signal is actuated by selecting the combined pattern, and always follows values of the amplitude signal during forming the pattern, and it issues ON signal when the amplitude values on changing become constant, exceeding two steps.

In response to the ON signal, the central processing unit 50 effects a selection of a pattern having a progressively varied amplitude from a minimum to a maximum or of a pattern having a progressively varied amplitude from a maximum to a minimum. When the selected pattern is stitched, ON signal is absent, and the central processing unit nullify all other stitch pattern while the selected pattern is being stitched.

A selected pattern memory 61 stores data about shapes of the selected patterns and data about control of amplitude and feed thereof.

A drive motor 62 drives the upper shaft 2, and is connected electrically to a controller (not shown) that controls starting, stopping and speed.

Figure 7:
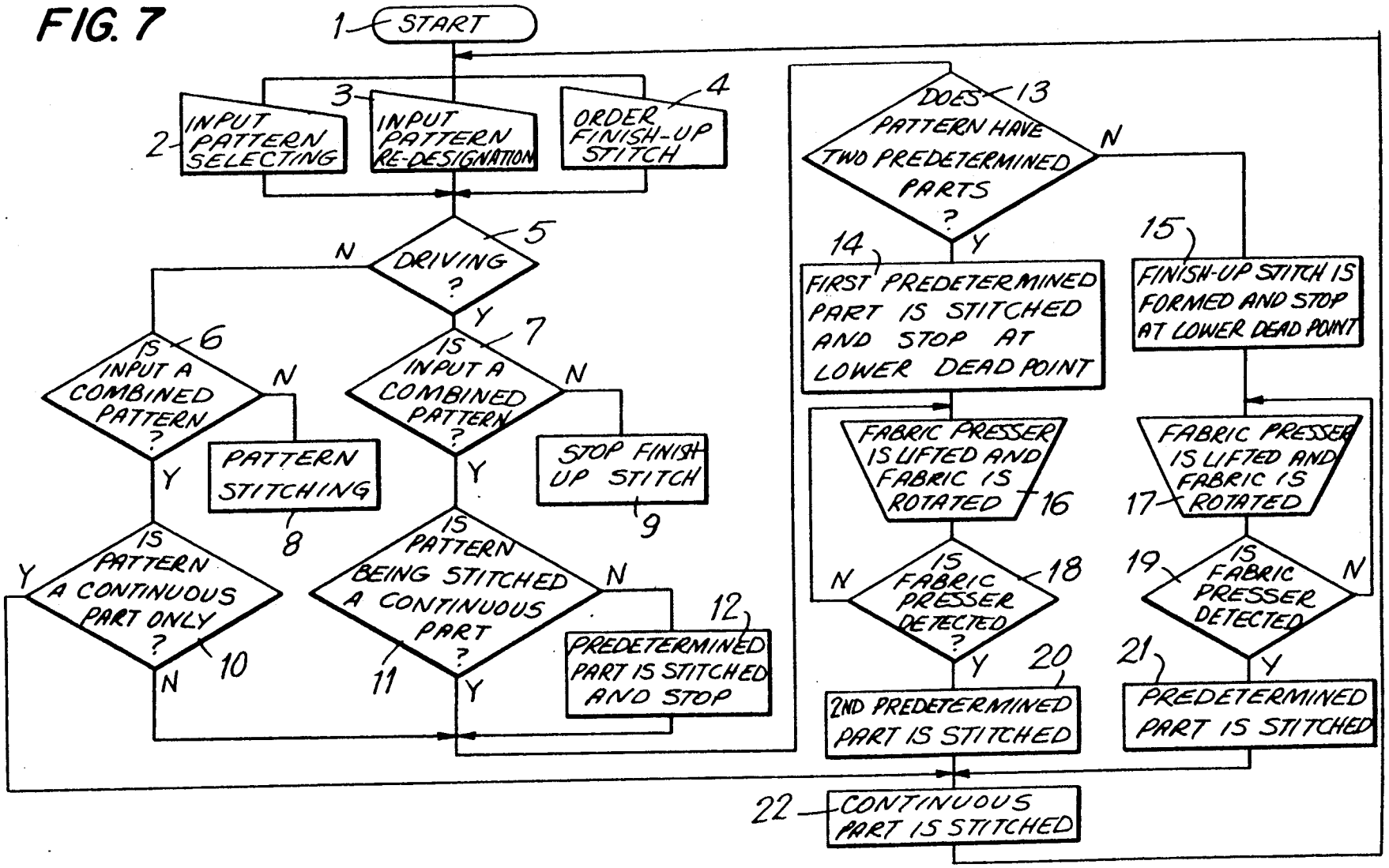
FIG. 7 is a flow chart for explaining operations of the invention.

A further explanation of the operation of the present embodiment will be made with reference to FIGS. 7 and 8.

Figure 8C:
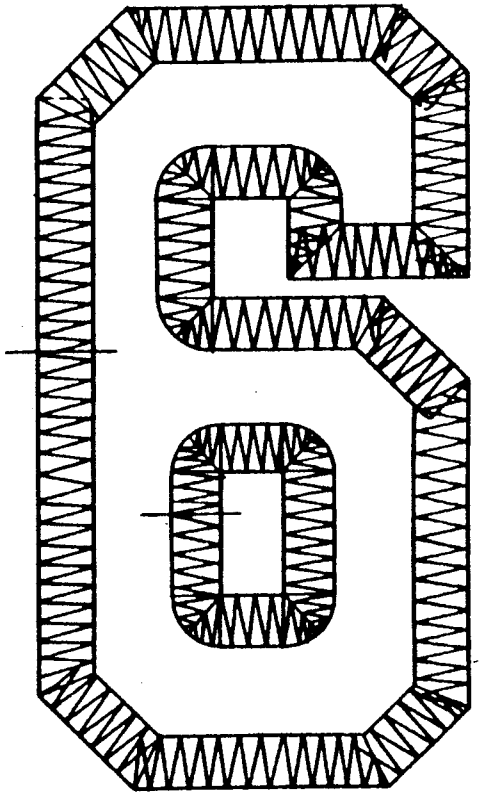
FIGS. 8(*a*)–8(*c*) are explanatory views showing forming patterns by combination of different portions thereof.
Figure 8B:
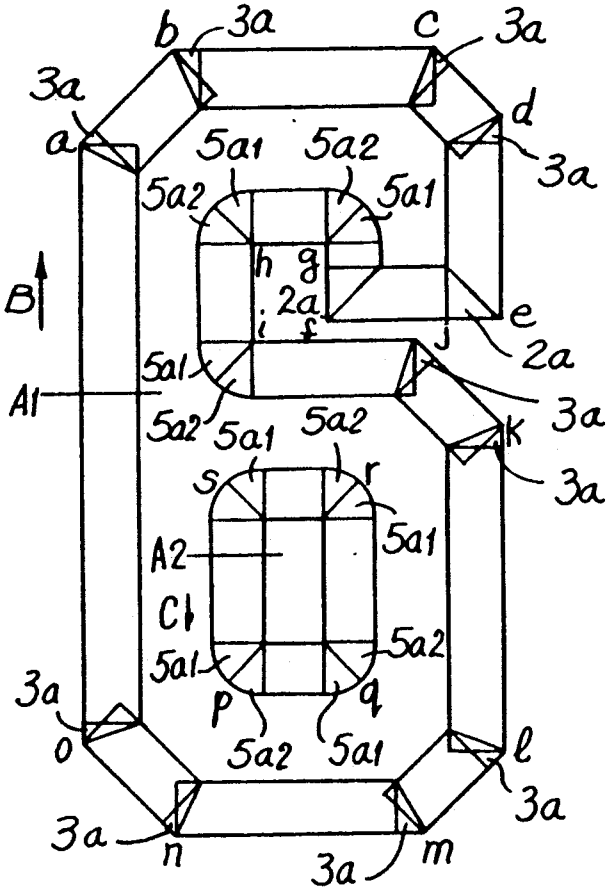
Figure 8A:
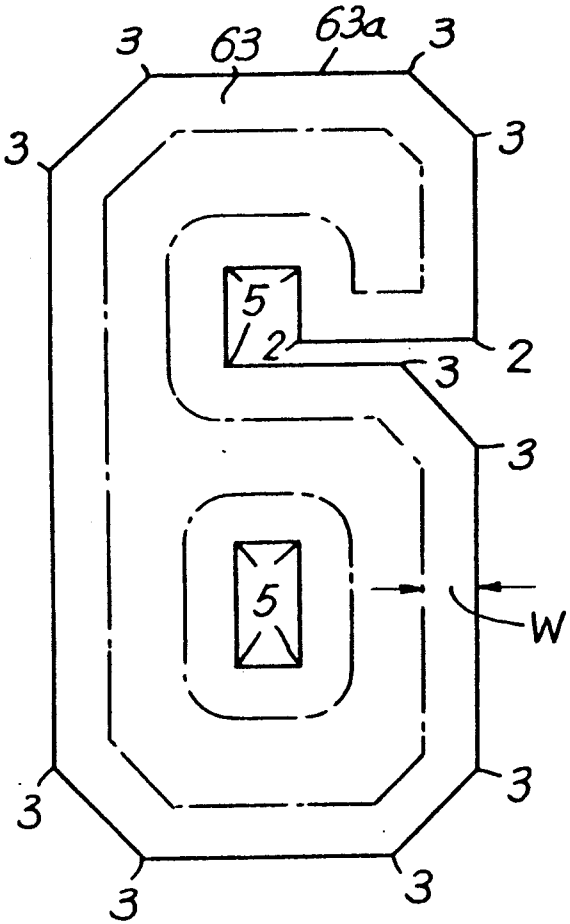

The player's number "6" is now formed on the uniform, and is shown with a reference numeral 63 in FIG. 8(*a*). The mark "6" is stitched at its outline 63*a* with a predetermined width as seen in FIG. 8. The predetermined width is an amplitude W, and when a width is optional, it is a value in advance stored in the sewing machine memory. When a width is designated, the amplitude selecting device 42, the increasing key 45 and the decreasing key 46 are operated to make the designation. The numerals 1 to 5 in FIG. 8(*a*) correspond to numbers of patterns to be combined.

For stitching the player's number 63 as the pattern, when the pattern selecting device 39 is operated to select the straight continuous pattern 1, the needle 17 drops at the left side of the pattern 1, and therefore the player's number 63 is brought to meet "A1" at the left side of the straight pattern, and a controller (not shown) is actuated to control stitching of the straight part until the portion "a" of FIG. 8(*b*). As this portion "a" corresponds to the pattern (3) of FIG. 5, it is selected by the pattern selecting device 39. The sewing machine is driven by the rotation detector 60. When ON signal is output at the determined amplitude value by the amplitude signal detector 54, the continuous part c is stitched. As the pattern (3) has one predetermined part a, the needle stops at the lower dead point of the outside of the pattern.

The lift lever 52 is operated to raise the fabric presser foot 56, and the fabric is met at the outside of the number and is turned by angle $\alpha$. The fabric foot 56 is dropped, and a counting value "1" is calculated by the lift lever detector 51, by which the central processing unit 50 allows to stitch the predetermined part a.

The controller is operated to stitch the predetermined part a of the pattern 3 and the stitch the continuous part b until a part "b".

Since a corner of a part "b" is the same as the pattern 3, the pattern 3 is selected or input by the pattern redesignation switch 59, and the needle is stopped at the upper dead point as the outside of the needle dropping position. The lift lever 52 is operated to raise the fabric presser foot 56, and the fabric is turned for stitching the predetermined part (a) and the continuous part (b) of the pattern (3).

Parts "c" and "d" of FIG. 8(b) are similarly stitched with the pattern (3), and since a part "e" of FIG. 8 is the pattern (2), the pattern 2 is selected and input by the pattern selecting device 39, and the needle is stopped at the lower dead point at the outside of the needle dropping position.

The lift lever 52 is operated to raise the fabric presser foot 56, and the fabric is met at the outline of the number, and is turned about 90°. The controller is operated to switch the predetermined part (a) and stitch the continuous part (b) until a part "f". Since the part "f" is the part (2), the pattern (2) is selected or input by the pattern redesignation switch 59 to stitch the predetermined part (a) and stitch the continuous part (b) until a part "g". Since the part "g" is the pattern (5), the pattern (5) is selected and input by the pattern selecting device 39.

Since the pattern (5) has two predetermined parts as shown in FIG. 5, a first predetermined part (a1) is stitched by a selecting input and the needle is stopped at the lower dead point as an outside position "d". The lift lever 52 is operated to raise the fabric presser foot 56, and the fabric is met at the outline of the number and is turned about 90°, and a second predetermined part (a2) is stitched and the continuous part b is stitched until a part "h".

Since the part "h" is the pattern (5), the pattern 5 is selected to stitch the first predetermined part (a1), and the needle is stopped. The lift lever 52 is operated to turn the fabric, and the second predetermined part (a2) is stitched and the continuous part b is stitched until a part "i". Since the part "i" is the pattern (5), the stitching is carried out on the first predetermined part (a1), the second predetermined part (a2), and the continuous part (b).

Since a part "j" is the pattern (3), the pattern 3 is selected and input by the pattern selecting device 39.

Parts k, 1, m, n, and o are all the pattern (3), and the selecting input switch or the pattern re-designation switch is operated to form stitches in succession. Coming to the starting point Al, the finish-up is ordered by the finish-up button and the hem stitching is accomplished as seen in FIG. 8(*c*). With respect to an inner part of the number pattern, if a starting point A2 is prepared on the straight line, stitching may be performed similarly as the outside stitching.

Since an outside of the inner part is arc shaped, stitching is started at a position A2 in a direction of an arrow C of FIG. 8(*b*). Therefore, when the pattern selecting device 39 is operated to select a straight continuous pattern (1), the needle is positioned at the left side of the amplitude of the pattern (1), and the fabric is brought to a predetermined position and is stitched until the straight portion of a part "p". Since the position "p" has two predetermined parts as seen in FIG. 5, (5), the pattern (5) is selected and input by the selecting input device 39. The first part a1 is stitched and is stopped at an outside part "d". The lift lever 62 is operated to turn the fabric and the number mark 90° clockwise, and the fabric presser foot 56 is brought down. The lift-up detecting means is thereby calculated, and the central processing unit allows to stitch the second predetermined part a2 .

The second predetermined part (a2) is stitched and the continuous part b is stitched until the straight part of a part "q". Since the corner of the part "q" is the pattern of FIG. 5 (5), the pattern (5) is selected by the selecting device 39, and similarly the first predetermined part (a1) and the second predetermined part (a2) stitched, and then the continuous part (b) is stitched until the straight part of a part "t". Since the corners of parts "t" and "s" are both the pattern (5), the stitching is carried out until the part A2 of FIG. 8.

The above mentioned operation takes place when the outside stitching follows the stitching direction B, and the inner side stitching follows the stitching direction C. With respect to the cases when the outside stitching moves in a direction opposite to the direction B and the inner side stitching moves in a direction opposite to the direction C, a reverse key is operated before selecting the patterns, so that patterns may be formed on opposite side of combined patterns shown in FIG. 5.

What is claimed is:

1. A sewing machine comprising a needle; a fabric feeding device; a fabric presser lifting lever; memory means for storing groups of pattern data which are selectively read out to control said needle and said fabric feeding device to produce a pattern of stitches on a fabric, said groups of pattern data stored including a plurality of part patterns which are selectively read out to form a complete single pattern of stitches, said part patterns including a first pattern of zigzag stitches of constant amplitude, a second pattern of zigzag stitches of progressively varied from a minimum to a maximum amplitude, and a third pattern of zigzag stitches of progressively varied from a maximum to a minimum amplitude; pattern selecting means including a plurality of selectively actuated buttons for reading out said first, second and third stitch patterns; detecting means for detecting each needle position of said first stitch pattern and generating an ON signal when more than two zigzag stitches of said constant amplitude are successively produced; control means for effecting a selection of any of said second and third stitch patterns in response to said ON signal, said detecting means cancelling said ON signal when, one of said second and third stitch patterns is selected thereby establishing a selected stitch pattern, and said control means nullifying the selection of the other stitch patterns while the selected stitch pattern is stitched in response to an absense of the ON signal; means for detecting a lift of said fabric presser lifting lever for turning the fabric relative to said needle and for detecting a fall of said fabric presser lever to thereby allow the selected stitch pattern to be stitched, said selected stitch pattern being programed to be followed by said first stitch pattern.

2. A method of stitching a mark of a predetermined shape onto a fabric on a sewing machine having a needle, a fabric feeding device, and a fabric presser lifting lever, said method comprising the steps of storing groups of pattern data which are selectively read out to control the needle and the fabric feeding device to produce a pattern of stitches on a fabric, said groups of pattern data stored including a plurality of part patterns which are selectively read out to form a complete single pattern of stitches, said part patterns including a first pattern of zigzag stitches of constant amplitude, a second pattern of zigzag stitches of progressively varied from a minimum to a maximum amplitude, and a third pattern of zigzag stitches of progressively varied from a maximum to a minimum amplitude; reading out said first, second and third stitch patterns; detecting each needle position of said first stitch pattern, generating an ON signal for selection of any of said second and third stitch patterns, and cancelling the ON signal when one of said second and third stitch patterns is selected thereby establishing a selected stitch pattern, to thereby nullify the selection of the other stitch patterns while the selected stitch pattern is stitched; detecting a lift of said fabric presser lifting lever for turning the fabric relative to said needle and detecting a fall of said fabric presser lever to thereby allow the selected stitch pattern to be stitched, said selected stitch pattern being programed to be followed by said first stitch pattern.

* * * * *